US009300060B2

(12) United States Patent
Niemann

(10) Patent No.: US 9,300,060 B2
(45) Date of Patent: Mar. 29, 2016

(54) TERMINAL

(71) Applicant: WAGO Verwaltungsgesellschaft mbH, Minden (DE)

(72) Inventor: Burkhard Niemann, Hille (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/640,803

(22) Filed: Mar. 6, 2015

(65) Prior Publication Data

US 2015/0255896 A1 Sep. 10, 2015

(30) Foreign Application Priority Data

Mar. 7, 2014 (DE) ..... 10 2014 103 059

(51) Int. Cl.
*H01R 25/00* (2006.01)
*H01R 9/26* (2006.01)
*H01R 25/16* (2006.01)

(52) U.S. Cl.
CPC ..... *H01R 9/2675* (2013.01); *H01R 9/2625* (2013.01); *H01R 9/2633* (2013.01); *H01R 9/2641* (2013.01); *H01R 25/168* (2013.01)

(58) Field of Classification Search
CPC ..... H01R 9/24; H01R 9/2491; H01R 9/26; H01R 9/2675; H01R 9/2633; H01R 9/2666; H01R 25/162; H01R 25/168; H01R 9/2641; H01R 9/2625; H04Q 1/142; H04Q 1/14; H02B 1/21
USPC ..... 439/121, 709, 715, 716, 922
See application file for complete search history.

(56) References Cited

U.S. PATENT DOCUMENTS

| | | | | |
|---|---|---|---|---|
| 4,159,500 | A | 6/1979 | Baumbach et al. | |
| 4,851,967 | A * | 7/1989 | Gerke | G01R 1/0416 361/823 |
| 6,196,862 | B1 * | 3/2001 | Dooley | H01R 4/2433 361/119 |
| 7,207,828 | B2 * | 4/2007 | Tricaud | H04Q 1/20 379/413.04 |
| 8,998,654 | B2 * | 4/2015 | Donhauser | H01R 13/02 439/709 |

FOREIGN PATENT DOCUMENTS

| | | |
|---|---|---|
| DE | 32 33 255 | 3/1984 |
| DE | 42 37 732 | 5/1994 |
| DE | 43 25 614 | 2/1995 |
| DE | 10 2006 052 894 | 5/2008 |
| DE | 10 2008 014 177 | 9/2009 |
| DE | 20 2010 009 293 | 12/2011 |
| DE | 20 2011 108 572 | 3/2012 |
| EP | 0637099 | 2/1995 |
| EP | 1921715 | 5/2008 |
| WO | 2013/167253 | 11/2013 |

* cited by examiner

*Primary Examiner* — Tulsidas C Patel
*Assistant Examiner* — Travis Chambers
(74) *Attorney, Agent, or Firm* — Renner, Otto, Boisselle & Sklar, LLP

(57) ABSTRACT

A terminal strip comprising an insulating housing and three busbar sections and comprising a disconnecting blade opening and a plug-type receptacle for a component plug connector is described.
The insulating housing has a channel, which leads from the first busbar section to the second busbar section, for receiving an electrically conductive bridging element. The bridging element is electrically conductively connectable or connected to the first and second busbar sections.

9 Claims, 6 Drawing Sheets

TERMINAL

Figure 1:
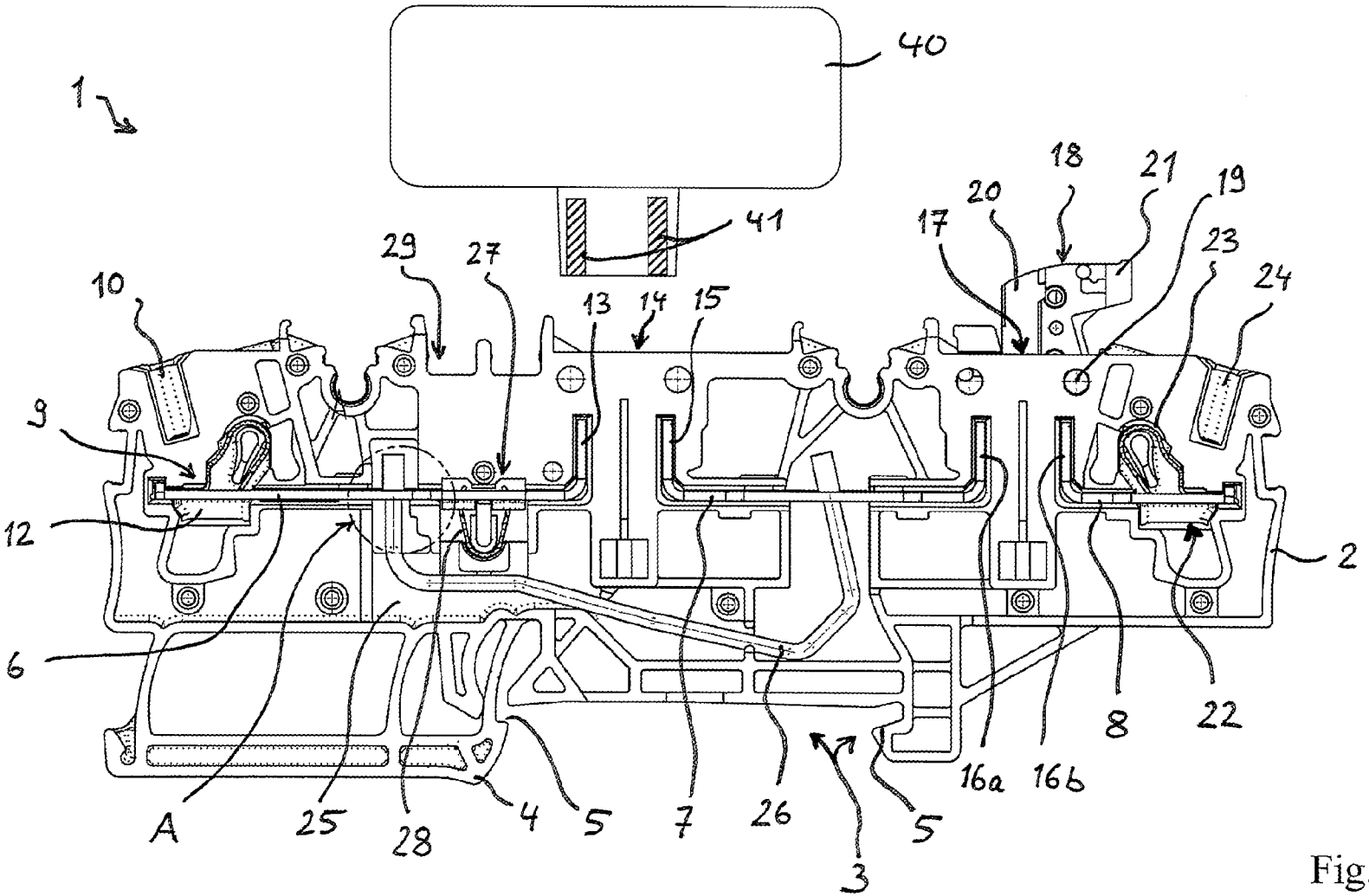

The invention relates to a terminal strip comprising an insulating housing, which has a latching foot for latching onto a mounting rail, at least two conductor insertion openings, a disconnecting blade opening and a plug-type receptacle for receiving a component plug connector, and comprising at least three busbar sections installed in the insulating housing, wherein the first busbar section has at least one conductor connection for making a terminal connection with an electrical conductor which can be inserted into an assigned conductor insertion opening and, diametrically opposite the at least one conductor connection, a first plug-type contact, which protrudes into the plug-type receptacle, for making electrically conductive contact with a component plug connector which can be plugged into the plug-type receptacle, wherein the second busbar section adjoins the first busbar section and has, at a first end, a second plug-type contact, which protrudes into the plug-type receptacle, for making electrically conductive contact with the component plug connector which can be plugged into the plug-type receptacle and, at its second end opposite the first end, has a disconnecting blade contact, which protrudes into the disconnecting blade opening, for making electrically conductive contact with a disconnecting blade, and wherein the third busbar section adjoins the second busbar section and has a disconnecting blade contact, which protrudes into the disconnecting blade opening, for making electrically conductive contact with the disconnecting blade and at least one conductor connection for making the terminal connection of an electrical conductor which is inserted into an assigned conductor insertion opening.

Terminal strips in a variety of forms are also known as disconnecting terminals comprising two separate busbar sections, which can be electrically disconnected from one another or electrically connected to one another via a pluggable or pivottable disconnecting blade.

Furthermore, terminal strips for mounting component plug connectors are known.

U.S. Pat. No. 4,159,500 A describes such a conductor connection terminal comprising two busbar sections, which lead to a plug-in location for a component plug connector. The component plug connector is connectable to protruding connection contact legs with spring plug-type contacts, which are electrically conductively connected to the respective busbar sections. When the component plug connector is removed, the spring contacts are short-circuited so that the busbar sections are then electrically conductively connected to one another.

DE 43 25 614 A1 discloses a terminal strip arrangement comprising overvoltage protection elements, which make contact firstly with a busbar of the terminal strip and secondly with a busbar (mounting rail) on which the terminal strip arrangement is mounted.

DE 10 2008 014 177 A1 discloses a terminal strip comprising two busbar sections, which can be electrically conductively connected to one another or disconnected from one another via a pivottably mounted disconnecting blade. Furthermore, transverse bridge openings for receiving transverse bridges are provided in order to connect two adjacent terminal strips electrically conductively to one another with the aid of a transverse bridge, which is brought into plug-type contact with the assigned busbar section.

WO 2013/167253 A1 discloses an electrical terminal strip comprising a pivottably mounted disconnecting lever and two connection shafts for receiving transverse bridges, for example. The receiving shafts lead to an assigned busbar section in order to make electrically conductive contact between said busbar section and a transverse bridge.

Against this background, it is the object of the present invention to provide a special terminal strip which can be used as basic terminal with a disconnecting function and which is also suitable for plugging on a component plug connector.

The object is achieved by the terminal strip having the features of Claim 1. Advantageous embodiments are described in the dependent claims.

It is proposed for a terminal strip of the generic type that the insulating housing furthermore has a channel, which leads from the first busbar section to the second busbar section, for receiving an electrically conductive bridging element, which is electrically conductively connectable or fixedly connected to the first and second busbar sections.

In the case of a terminal strip comprising a disconnecting blade opening for receiving a disconnecting blade, which terminal strip has three busbar sections and a latching foot for latching onto a mounting rail, bridging of the first and second busbar sections by means of a bridging element received in the channel is provided by virtue of the channel leading from the first to the second busbar section. Thus, the basic terminal can be configured at the factory or by the user by installing a bridging element such that the first and second busbar sections are electrically conductively connected to one another. In this case, a plugged-in component plug connector would make electrically conductive contact between the first and second busbar sections and the at least one electrical conductor, which possibly has a terminal connection to the assigned conductor connection. A potential tap is therefore possible by virtue of the component plug connector. A component plug connector which is plugged in so as to span at least two terminal strips arranged parallel to one another on the mounting rail can perform largely electrical functions. Such a component plug connector may be, for example, a lightning protection module, which is plugged onto a plurality of terminal strips arranged next to one another, of which one terminal strip is connected to ground or earth (GND) and at least one further terminal strip conducts potential.

The terminal strip can optionally also be used without a bridging element, however. In this case, the component plug connector is electrically conductively connected firstly to the first busbar section and secondly to the second busbar section with the aid of the plug-type contacts protruding into the plug-type receptacle. The additional channel between the first and second busbar sections therefore enables an additional bridging element to be received. A complex configuration of the plug-type contacts such that they automatically produce an electrically conductive connection between the first and second busbar sections when a component plug connector is removed can be dispensed with. In addition, the plug-type receptacle for the component plug connector remains free, in comparison with the simplest solution in which simply a bridging plug connector, which bridges the first and second plug-type contacts of the first and second busbars, is plugged into the plug-type receptacle instead of a component plug connector.

Therefore, the terminal strip forms a universal basic terminal, which can be matched specifically by means of simple modification.

It is particularly advantageous if the latching foot has an electrically conductive latching arm for electrically conductive connection to a mounting rail when the terminal strip is latched onto a mounting rail. In this case, in the preferred embodiment, when the channel leads to the latching arm, the bridging element can be electrically conductively connected to the latching arm.

Therefore, it is optionally possible in the factory or at the user end to electrically conductively connect at least one of the first or second busbar sections or both busbar sections jointly to the latching arm and therefore to the mounting rail and to therefore use the basic terminal as PE terminal.

These options are provided by virtue of the provision of a corresponding channel in the insulating housing for receiving a suitable bridging element.

Furthermore, it is advantageous if the insulating housing has at least one bridge shaft for receiving a transverse bridge. This bridge shaft leads to one of the busbar sections and a bridge contact for a transverse bridge plug-type contact is provided on this assigned busbar section. Such transverse bridges usually have electrically conductive contact blades or spring pins, which are plugged into openings in the busbar sections, such as slots, for example.

The channel for receiving the bridging element is preferably arranged in the space between the latching foot and the first and second busbar sections. Thus, the space above the busbar sections in which the conductor insertion openings for the electrical conductors to be terminally connected, the plug-type receptacle for receiving a component plug connector and the disconnecting blade opening for receiving a disconnecting blade are arranged, remains free from the bridging element. Said bridging element is instead received in the region below the busbar, which points towards the mounting rail and the latching foot. In this region, there is usually still sufficient space available in a terminal strip, even taking into consideration the required air gaps and leakage paths.

The bridging element can be, for example, a cable or busbar piece which is fixedly soldered, welded, riveted or pressed onto the first and second busbar pieces. This is particularly an option when the terminal strip is provided at the factory end.

However, it is also conceivable for the first and/or second busbar section to have plug-type contact elements for making plug-type contact between the bridging element and the assigned busbar section. Thus, for example, a spring clamping contact for making clamping contact with a cable or bridging element on the first and/or second busbar section can be provided.

It is particularly advantageous if the first and/or second busbar section has an aperture, such as a slot, for example, for receiving and making contact with an assigned free end of the bridging element. The bridging element is then inserted into the aperture with a flattened free end, for example, and electrically conductive contact is made there between the two. This can take place or be assisted possibly also by means of a spring element or by other mechanical and/or thermal connections.

The bridging element in all of the described embodiments may be a cable, a wire, a pin, a current bar or the like.

The disconnecting blade which can be inserted into the disconnecting blade opening can either be articulated pivottably on the insulating housing, or else the disconnecting blade can be embodied separately from the terminal strip and plugged into the disconnecting blade opening in order to connect the second and third busbar sections.

Figure 2:
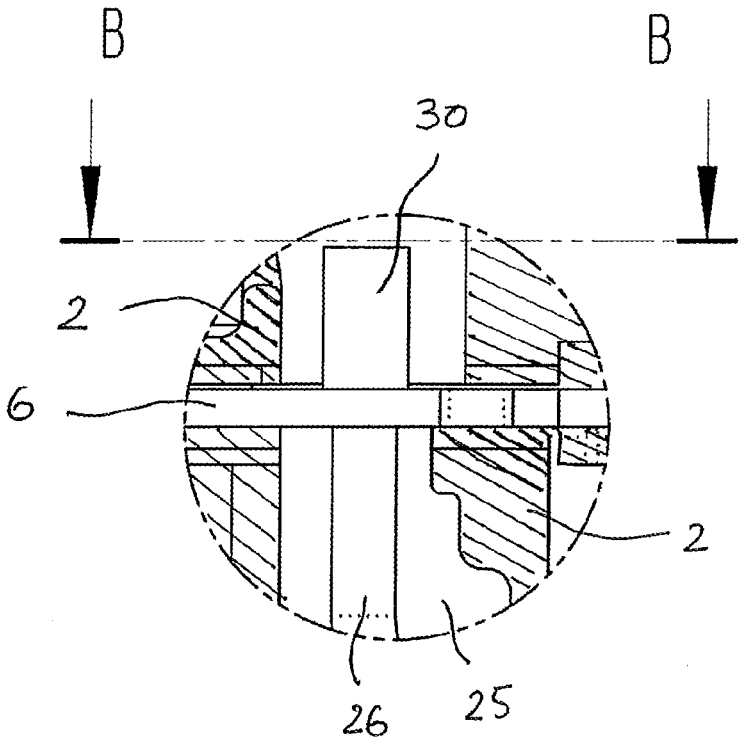
Figure 3:
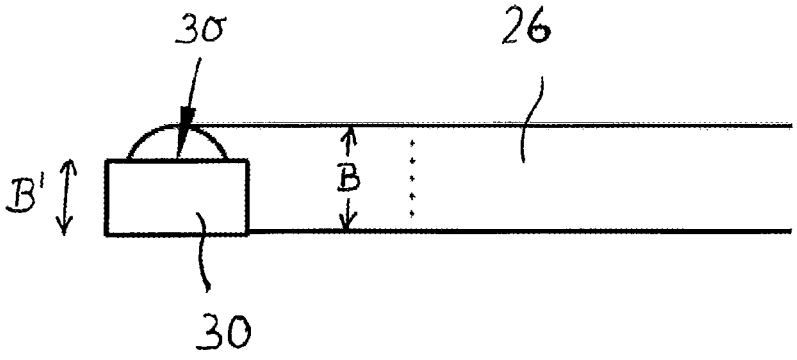
Figure 4:
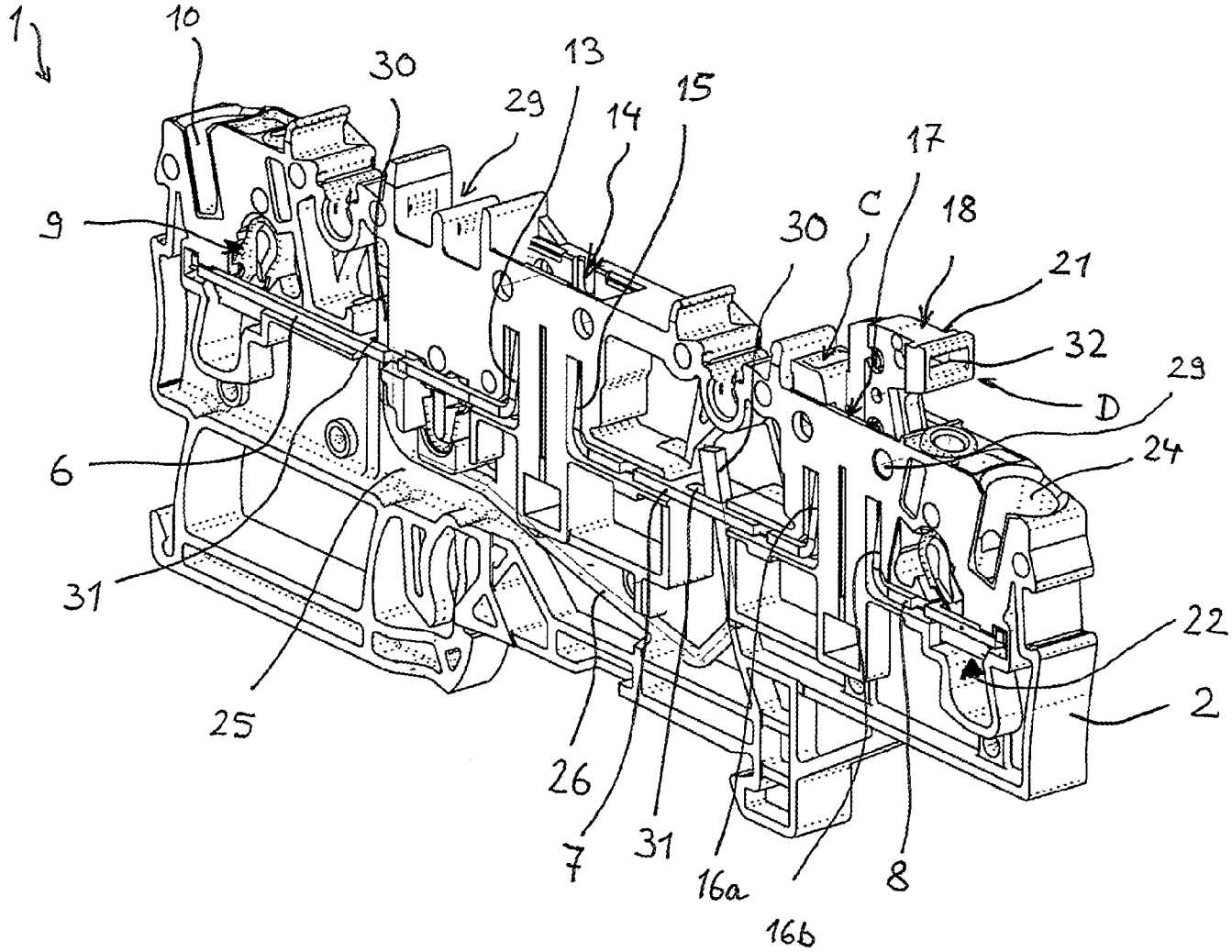
Figure 5:
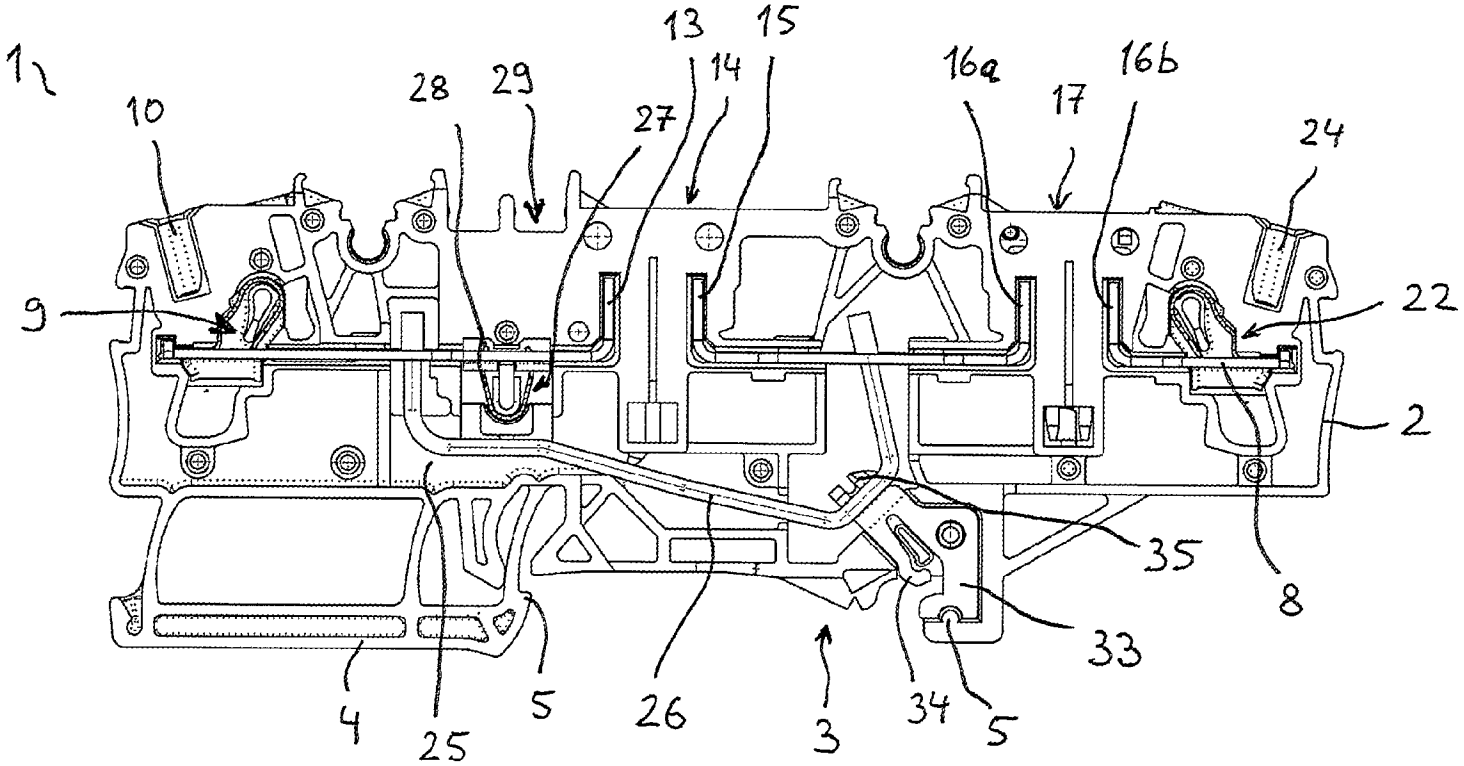
Figure 6:
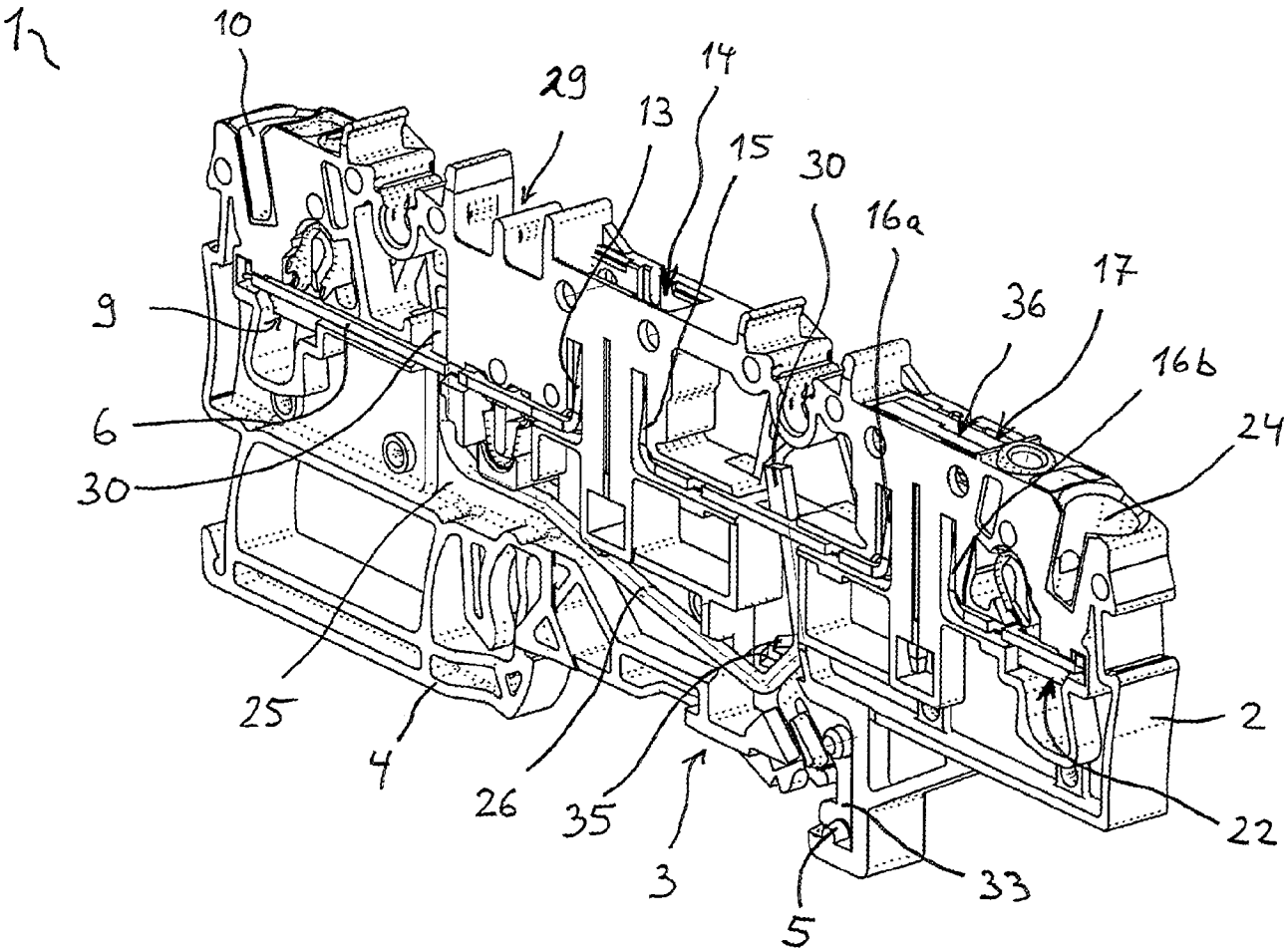
Figure 7:
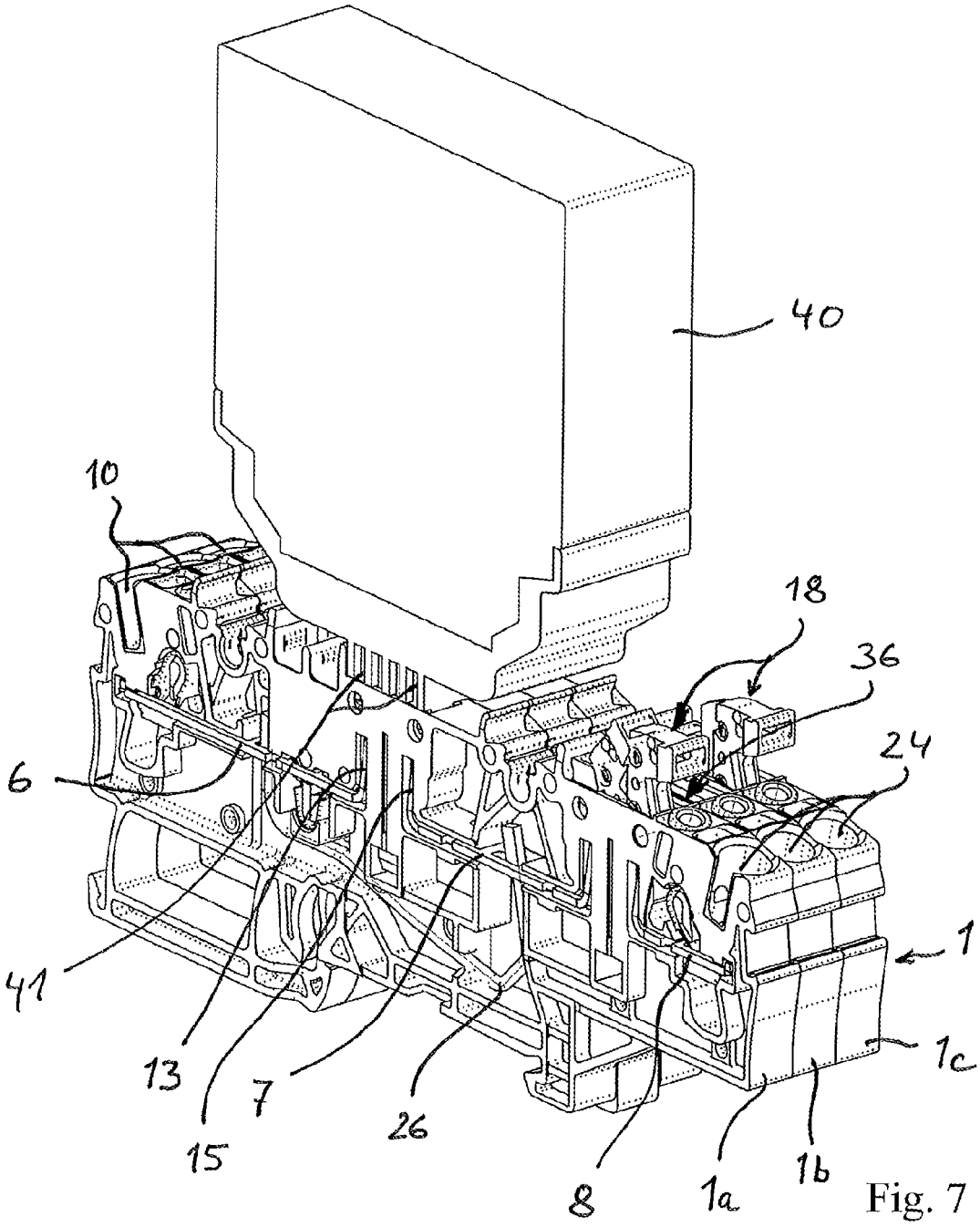

The invention will be explained in more detail below with reference to exemplary embodiments using the attached drawings, in which:

FIG. 1—shows a side view of a first embodiment of a terminal strip;

FIG. 2—shows a detail view in region A of the terminal strip shown in FIG. 1;

FIG. 3—shows a sectional view in the section B-B of the terminal strip detail shown in FIG. 2;

FIG. 4—shows a perspective view of the terminal strip shown in FIG. 1;

FIG. 5—shows a side view of a second embodiment of a terminal strip;

FIG. 6—shows a perspective view of the terminal strip shown in FIG. 5;

FIG. 7—shows a perspective view of a terminal strip arrangement comprising three terminal strips arranged next to one another and a component plug connector plugged onto the terminal strips so as to span said terminal strips.

FIG. 1 shows a side view of a first embodiment of a terminal strip 1 having an insulating housing 2. The insulating housing 2 has, in the lower region, a latching foot 3 comprising a movably mounted latching arm 4 and comprising latching tabs 5 for engaging beneath a mounting rail, when the terminal strip 1 has been positioned on such a mounting rail, which is known per se. The terminal strip 1 is then latched on the mounting rail with the aid of the latching tabs 5.

Furthermore, three busbar sections 6, 7, 8 are installed in the insulating housing 2. The first busbar section 6 has a conductor connection 9 for the terminal connection of an electrical conductor which can be inserted into an assigned conductor insertion opening 10 in the insulating housing on the side opposite the latching foot 3. The conductor connection is in the form of a spring-force clamping connection comprising a clamping spring 11, which is suspended in a conductor receiving opening in the first busbar section 6, for example. The conductor insertion opening 10 is provided with a perforated collar 12, with which an electrical conductor is guided laterally.

Other types of conductor connections 9 are conceivable, such as, for example, conductor connections comprising cage strain springs, screw-type clamping contacts, insulation displacement clamping contacts or plug-type contacts for receiving mating plug connectors or the like.

A plug-type contact 13, which protrudes from the plane of the first busbar section 6 pointing upwards away from the latching foot 6, is provided at that end of the first busbar section 6 which is opposite the conductor connection 9. This plug-type contact 13 protrudes into a plug-type receptacle 14, which is formed in the insulating housing 2 for receiving a component plug connector 40. This plug-type receptacle therefore forms a receiving space for a plug-type contour of a component plug connector 40, which can be electrically conductively connected to the plug-type contact 13 using suitable mating contacts 41.

A second busbar section 7 is arranged in the insulating housing 2 adjacent to the first busbar section 6. This busbar section 7 has a plug-type contact 15, which likewise protrudes into the plug-type receptacle 14, at the first end. This plug-type contact 15 is bent back pointing away from the plane of the second busbar section 7.

A disconnecting blade contact 16*a*, which is likewise bent back out of the plane of the second busbar section 7 pointing away from the latching foot and protrudes into a disconnecting blade opening 17, is provided at that end of the second busbar section 7 which is opposite this plug-type contact 15.

In this exemplary embodiment illustrated, a disconnecting blade 18 is mounted pivottably in the disconnecting blade opening 17. For this purpose, a mounting shaft 19 is arranged on the side opposite the plug-type contact 16 of the second busbar section 7 above a third busbar section 8. The disconnecting blade 18 can be pivoted away from the plug-type receptacle 14 and a component plug connector 40 inserted there in this way.

The disconnecting blade 18 has an electrically conductive blade part 20, which is integrally formed or fitted with a handle part 21, formed from insulating material, of the disconnecting blade 18.

The third busbar section 8 likewise has a disconnecting blade contact 16*b*, which leads into the disconnecting blade opening 17 and is oriented in relation to the first disconnecting blade contact 16*a* and the blade part 20 of the disconnecting blade 18 in such a way that, when the disconnecting blade 18 is pivoted into the insulating housing 2, the blade element 20 makes electrically conductive contact with and bridges the two disconnecting blade contacts 16*a*, 16*b*. The disconnecting blade contacts 16*a*, 16*b* can be in the form of fork contacts, for example, comprising two fork prongs which are spaced apart from one another by a slot for receiving the blade element 20.

Correspondingly, the plug-type contacts 13, 15 for the component plug connectors can also be in the form of fork contacts.

The third busbar section 8 likewise has a conductor connector 22 on its side opposite the disconnecting blade contact 16*b*, said conductor connection being in the form of, for example, a spring-force clamping connection comprising a clamping spring 23. In this regard, reference can be made to the details provided in respect of the first busbar section 6. In this case too, a conductor insertion opening 24 for inserting an electrical conductor is provided on that side of the insulating housing 2 which is opposite the latching foot 3. The conductor insertion opening 24 leads to the conductor connection 22.

Provision is now made for a channel 25 for receiving an electrically conductive bridging element 26 to be provided in the space between the lower side of the first and second busbar sections 6, 7 and the latching foot 3. Thus, a space is provided in which optionally an electrically conductive bridging element 26, for example in the form of a cable, a current bar (busbar), a wire or pin or the like can be received. This channel 25 leads to that region of the first busbar section 6 which is between the conductor connection 9 and the plug-type contact 13 and to a region between the plug-type contact 15 and the disconnecting blade contact 16*a* of the second busbar section 7. These regions are provided in order to produce an electrically conductive connection between the bridging element 26 and the first and second busbar sections 6, 7. In this case, the bridging element 26 can be connected mechanically fixedly to the assigned first and second busbar sections 6, 7, for example by means of soldering, welding, riveting, crimping, caulking or the like. However, it is also conceivable for the first and second busbar sections 6, 7 to have a plug-type contact element, which enables retrospective simple plug-type contact making with a bridging element 26.

Furthermore, it can be seen that, for example, the first busbar section 6 has a bridge contact 27 comprising a contact spring 28 adjacent to the contact point for the bridging element 26, said contact spring being suspended in a suitable cutout in the first busbar section 6. A transverse bridge opening 29 for receiving one or two transverse bridges next to one another, leads to this bridge contact 27, the contact leg of each of said transverse bridges being electrically conductively connectable to the bridge contact 27.

Correspondingly, it is conceivable for a spring element to be suspended in a slot in the first busbar section 6 for the bridging contact 26 as well in order to enable spring-force plug-type contact making of the bridging element 26, preferably in the form of a cable, a wire or a current bar.

FIG. 2 shows a detail view in the detail A shown in FIG. 1. In this case, the region of the connection of the bridging element 26 to the first busbar section 6 is shown more clearly. It can be seen that the bridging element 26 is plugged through an opening, for example a slot, in the first busbar section 6, wherein that free end of the bridging element 26 which protrudes out of the upper side of the first busbar section 6 has a greater width than the part of the bridging element 26 therebelow. This widened free end is passed through the correspondingly narrow slot and is electrically conductively connected to the side edges of the bridging element 26 of the slot.

FIG. 3 shows a sectional view in the section B-B shown in FIG. 2 in plan view of the first busbar section 6. It becomes clear that the free end of the bridging element 26 in the form of a current bar has experienced flattening in comparison with the other width B of the bridging element.

The free end 30 therefore has a smaller width B' than the width B of the bridging element 26.

FIG. 4 shows a perspective view of the terminal strip 1 shown in FIG. 1. In this case, it becomes clear that the bridging element 26 is bent in the form of an electrically conductive bar or current bar from the first busbar section 6 passing through the channel 25 to the second busbar section 7. The free ends 30 of the bridging element 26 are in this case passed through slots 31 in the respective busbar section 6, 7 and electrically conductively connected to the assigned first or second busbar section 6, 7 in the region of the slot 31.

Also clearly shown are the plug-type receptacle 14 and the disconnecting blade opening 17, which are diametrically opposite the latching foot 3, on the upper side of the insulating housing 2.

It can also be seen that the handle part 21 of the disconnecting blade 18 has an actuating opening 32 for receiving the free end of a screwdriver, for example, in order to move the disconnecting blade from the bridging position C (likewise sketched) into the pivoted-out open position D.

FIG. 5 shows a side view of a second embodiment of a terminal strip 1. In turn, three busbar sections 6, 7, 8 are also provided here, so that essentially reference can be made to what has been mentioned previously.

In contrast to the first embodiment, the latching foot 3 has an electrically conductive latching arm 33 comprising a spring-elastic latching finger 34 in order to make electrically conductive contact with the likewise electrically conductive mounting rail in the latched-on state. Thus, a PE terminal strip is provided, with which a connection to ground is possible. For this purpose, the bridging element 26 is guided along the latching arm 33 and electrically conductive contact is made with said bridging element there. For example, the latching arm 33 can be inserted with its free, spread-open end 35 into a suitably matched contact opening in the bridging element 26 and electrically conductively connected to the bridging element 26.

In this embodiment, no disconnecting blade 18 installed pivottably in the insulating housing 2 is provided. Instead, a separate disconnecting plug (not illustrated) is provided, which can be plugged into the disconnecting blade opening 17 and is electrically conductively connectable to the disconnecting blade contacts 16*a*, 16*b* there.

FIG. 6 shows a perspective view of the second embodiment of the terminal strip 1 shown in FIG. 5. In this case, it becomes yet clearer that a separate disconnecting plug connector 36 has been plugged into the disconnecting blade opening 17.

It can also be seen that the electrically conductive latching arm 33 engages around the bridging element 26 with its spreading end 35, in the form of a fork contact, and makes electrically conductive contact with said bridging element 26, wherein an additional cohesive connection can also be advantageous.

Moreover, reference can be made to the first embodiment. In the first embodiment, a disconnecting plug connector 36 of the second embodiment can also be provided in place of the pivottable disconnecting blade 18. However, it is also conceivable for a pivottable disconnecting blade 18 of the first embodiment to be provided in place of the pluggable disconnecting plug connector 36 in the second embodiment.

FIG. 7 shows a perspective view of a terminal strip arrangement comprising three terminal strips 1*a*, 1*b*, 1*c* arranged next to one another. In respect of the design of these terminal strips, reference can be made to the above description relating to the terminal strips 1 in conjunction with FIGS. 1 to 6.

It becomes clear that the two outer terminal strips 1*a* and 1*c* each have a pivottable disconnecting blade 18 and therefore correspond to the versions of the terminal strips 1 illustrated in FIGS. 1 and 4. The central terminal strip 1*b*, on the other hand, has a pluggable disconnecting plug connector 36 instead of a pivottably mounted disconnecting blade and is therefore embodied corresponding to the terminal strip 1 in FIGS. 5 and 6. In the exemplary embodiment illustrated, the central terminal strip 1*b* is used for signal transmission. The disconnecting plug connector 36 and the bridging element 26 for the first and second busbar sections 6 and 7 in the central terminal strip 1*b* ensure that a signal, which is fed, for example, via an electrical line the conductor insertion opening 24 of the central terminal strip 1*b*, is also present at an electrical conductor inserted into the opposite conductor insertion opening 10 in any case even without a component plug connector 40. The pluggable disconnecting plug connector 36 ensures that a signal cannot be interrupted readily, such as during opening of a pivottable disconnecting blade 18.

The two outer terminal strips 1*a* and 1*c* of the terminal strips 1*a*, 1*b*, 1*c*, which are arranged directly adjoining one another next to one another on a mounting rail (not illustrated), are connected to voltage potential or ground, on the other hand.

In this terminal strip arrangement illustrated, a component plug connector 40 is now positioned so as to span all of the three terminal strips 1*a*, 1*b*, 1*c* arranged next to one another, wherein the component plug connector 40 is electrically conductively connected in the plugged-on state to the first and second busbar sections 6, 7 of a plurality of terminal strips 1*a*, 1*b*, 1*c* arranged next to one another with the aid of mating contacts 41, which are matched to the plug-type contacts 13, 15 of the terminal strips 1*a*, 1*b*, 1*c*.

If the component plug connector 40 is an overvoltage protection element, the component plug connector 40 can have electronics, for example, with which the voltage-potential-conducting busbar sections 6, 7 of one of the terminal strips, for example terminal strip 1*c*, is connected to the busbar sections 6, 7 of the opposite outer terminal strip, for example terminal strip 1*a*, which is connected to ground potential, in the event of an overvoltage in order to dissipate energy. In this case, an electrically conductive connection between the component plug connector 40 and the signal-conducting terminal strip 1*b* does not necessarily need to be provided. However, also conceivable are other variants and electronics of component plug connectors 40 in which the electronics are electrically conductively connected to other combinations of the terminal strip or to one of the terminal strips 1*a*, 1*b*, 1*c* or to all of the terminal strips 1*a*, 1*b*, 1*c* in the plugged-on state.

The invention claimed is:

1. A terminal strip comprising an insulating housing, which has a latching foot for latching onto a mounting rail, at least two conductor insertion openings, a disconnecting blade opening and a plug-type receptacle for receiving a component plug connector, and comprising at least three busbar sections installed in the insulating housing, wherein the first busbar section has at least one conductor connection for making a terminal connection with an electrical conductor which can be inserted into an assigned conductor insertion opening and, diametrically opposite the at least one conductor connection, a first plug-type contact, which protrudes into the plug-type receptacle, for making electrically conductive contact with a component plug connector which can be plugged into the plug-type receptacle, wherein the second busbar section adjoins the first busbar section and has, at a first end, a second plug-type contact, which protrudes into the plug-type receptacle, for making electrically conductive contact with the component plug connector which can be plugged into the plug-type receptacle and, at its end opposite the first end, has a disconnecting blade contact, which protrudes into the disconnecting blade opening, for making electrically conductive contact with a disconnecting blade, and wherein the third busbar section adjoins the second busbar section and has a disconnecting blade contact, which protrudes into the disconnecting blade opening, for making electrically conductive contact with the disconnecting blade and at least one conductor connection for making the terminal connection of an electrical conductor which can be inserted into an assigned conductor insertion opening, wherein the insulating housing furthermore has a channel, which leads from the first busbar section to the second busbar section, for receiving an electrically conductive bridging element, which is electrically conductively connectable or connected to the first and second busbar sections.

2. The terminal strip according to claim 1, wherein the latching foot has an electrically conductive latching arm for electrically conductive connection to a mounting rail when the terminal strip is latched onto a mounting rail, wherein the bridging element is electrically conductively connectable or connected to the latching arm.

3. The terminal strip according to claim 1, wherein the insulated housing furthermore has a bridge shaft for receiving a transverse bridge, wherein the bridge shaft leads to one of the busbar sections and a bridge contact for a transverse bridge plug-type contact element is provided on this assigned busbar section.

4. The terminal strip according to claim 1, wherein the channel for receiving the bridging element is arranged in the space between the latching foot and the first and second busbar sections.

5. The terminal strip claim 1, wherein the bridging element is a cable or busbar piece which is fixedly soldered, welded, riveted or pressed onto the first and second busbar sections.

6. The terminal strip according claim 1, wherein the first and/or second busbar section has plug-type contact elements for making plug-type contact between the bridging element and the assigned busbar section.

7. The terminal strip according claim 1, wherein the first and/or second busbar section has an aperture for receiving and making contact with an assigned free end of the bridging element.

8. The terminal strip according to claim 1, wherein the disconnecting blade is articulated pivottably on the insulating housing.

9. The terminal strip according to claim 1, wherein the disconnecting blade is embodied separately from the terminal strip and can be plugged into the disconnecting blade opening.

* * * * *